US005575123A

United States Patent [19]

Adams

[11] Patent Number: 5,575,123

[45] Date of Patent: Nov. 19, 1996

[54] EXTRUDED VINYL DOOR JAMB ASSEMBLY

[76] Inventor: Carl W. Adams, 5450 N. Eugene, Boise, Id. 83703

[21] Appl. No.: 551,718

[22] Filed: Nov. 1, 1995

[51] Int. Cl.[6] ..... E06B 1/60

[52] U.S. Cl. ..... 52/212; 52/215

[58] Field of Search ..... 52/211, 212, 215, 52/217; 49/504, 505

[56] References Cited

U.S. PATENT DOCUMENTS

| | | | |
|---|---|---|---|
| 3,345,780 | 10/1967 | McGhee | 49/504 |
| 3,349,519 | 10/1967 | Nehlig | 49/504 |
| 3,420,003 | 1/1969 | Cline | 52/212 X |
| 3,676,966 | 7/1972 | Ragland | 52/211 |
| 4,034,513 | 7/1977 | Richardson | 49/504 |
| 4,223,494 | 9/1980 | Wendt | 52/211 |
| 4,614,068 | 9/1986 | Bergthold | 52/211 |
| 4,674,248 | 6/1987 | Hall | 52/212 |
| 4,819,392 | 4/1989 | Day | 52/211 |
| 5,115,197 | 5/1992 | Tillery et al. | 49/504 |
| 5,233,802 | 8/1993 | Rogers | 52/217 X |

*Primary Examiner*—Carl Friedman
*Assistant Examiner*—Timothy Kang
*Attorney, Agent, or Firm*—Frank J. Dykas

[57] ABSTRACT

A vinyl door frame assembly for a frame door opening is provided with a plurality of metal jamb backing members for attachment to the unfinished door frame. A set of paired first and second vinyl jamb members are provided, wherein the first vinyl jamb member sections are attached to the metal jamb backing members by means of threaded screws, and the second section of vinyl jamb members are slid against the first vinyl jamb members and held in position by means of flat head screws interfitting within slots of the metal jamb backing members, and into snap fit engagement with the first section of vinyl jamb member to complete the assembly.

3 Claims, 7 Drawing Sheets

EXTRUDED VINYL DOOR JAMB ASSEMBLY

BACKGROUND OF THE INVENTION

1. Technical Field

The present invention relates to a door frame assembly, and more particularly to a door frame assembly comprising a two-piece extruded vinyl door jamb secured to the frame of the door opening by use of metal tabs and a snap engaging feature of the door jamb itself.

2. Background

Commercial and residential builders are always looking for ways to cut costs associated with building. This can be done in a number of ways, the two most popular being decreasing labor time and decreasing material costs. Quite simply, one of the most labor intensive as well as material cost intensive phases of construction is finish work for doors.

A number of solutions have been offered to eliminate the costs associated with this aspect of construction. In Day, U.S. Pat. No. 4,819,392, a metal frame system for use as a door frame, window frame or the like utilizing vertical frame members adapted for attachment to wood or steel studs. This system uses a pair of wedges to hold the system in compressive engagement.

Hall, U.S. Pat. No. 4,674,248, discloses a fire-resistant dual layer bimetallic door frame comprising a fire resistant inner layer and an aesthetic metallic outer layer.

Bergthold, U.S. Pat. No. 4,614,068, describes a metal door frame assembly for mounting a door opening. The Bergthold frame comprises in part an inward extruded metal portion which is secured to the door opening and second one piece extruded metal outward member which snap engages the inner member.

Wendt, U.S. Pat. No. 4,223,949, discloses a door frame assembly for partition wall construction comprising a metal backer jamb member and a one piece vinyl jamb outer member which snap engages with the metal backer jamb member.

Richardson, U.S. Pat. No. 4,034,513, describes a structural members which are adapted to support wall panels and accommodate the installation of doors and paneled walls.

Ragland, U.S. Pat. No. 3,676,966, describes a door frame assembly for mounting in a door opening using concealed support members to support the weight of the door. Ragland describes the use of an aluminum one-piece jamb assembly in conjunction with the concealed support members.

McGhee, U.S. Pat. No. 3,345,780, describes a unitary, integrally formed door frame unit which includes a pair of elongated parallel side members bridged together at their top ends by a top member, each piece being formed of multiple layers of fiberglass. Each of these pieces is secured to the door frame by the use of screws.

Nehlig, U.S. Pat. No. 3,349,519, discloses a door jamb assembly having a pair of L-shaped corner sections formed of a synthetic material which are fixed to a backing board and applied to the door opening and a wall.

Tillery et al., U.S. Pat. No. 5,115,597, teaches a universal door jamb package of essentially three piece construction and suitable for operation with standard layout doors having knobs spaced approximately thirty-six inches from the bottom edge of the door.

As can be seen from the prior art, numerous approaches have been taken to minimize cost and time associated with this phase of construction. However, none of the above-cited references exhibit the advantages of the present invention. Namely, an extruded vinyl door frame assembly, which may be used with any type of framing components, typically either wood or steel, and which relies on the use of a metal backing tab, which is attached directly to the frame elements for attachment of the jamb pieces, the hinges and thus the door.

Therefore, it is an object of the present invention to provide an extremely simple device for allowing the finishing of door frame openings.

DISCLOSURE OF INVENTION

This object is achieved through use of a vinyl door jamb assembly having first, second and third jamb members, first and second section header members, and a plurality of jamb backing members. The jamb backing members are each formed of two sections, a hinge backing plate and a leg segment. Hinge backing plate section is provided with a plurality of threaded machine screw holes and at least one through hole. The leg segment includes a screw head receiving slot which is adapted to receive and hold the flat heads of screws attached to the back side of the second jamb member. These jamb backing members may be formed of either metal, plastic or other suitable material. For the hinge side of the door frame, the jamb backing members are pre-positioned against the frame members of the framed doorway. The first jamb member is placed within the frame door opening and attached to the corresponding jamb backing members by means of machine screws passing through a hinge plate, the first jamb member, and engaging and threaded machine screw holes of the hinge backing section of jamb backing members. The hinge plate assembly is then completed by the use of a wood or metal screw passing through the first jamb member and the hinge backing plate and engaging into the door frame member.

Flat head screws are then screwed into threaded screw holes in the back side of the second jamb member and then slid into the slots formed in the leg segments of the jamb backing members as the second jamb member is slid into position against the now affixed first jamb member within the frame. Snap fit engagement is achieved between the first and second jamb members by use of cooperating snap connectors.

For the strike plate side of the door jamb and the header, threaded screws are first used to install the hinge backing plate section of the jamb backing plate to the third jamb member, from behind, after which the leg segments of the jamb backing plates are attached to the door frame member and a second jamb member is installed the same as it is for the first jamb member.

BEST MODE FOR CARRYING OUT INVENTION

Figure 1:
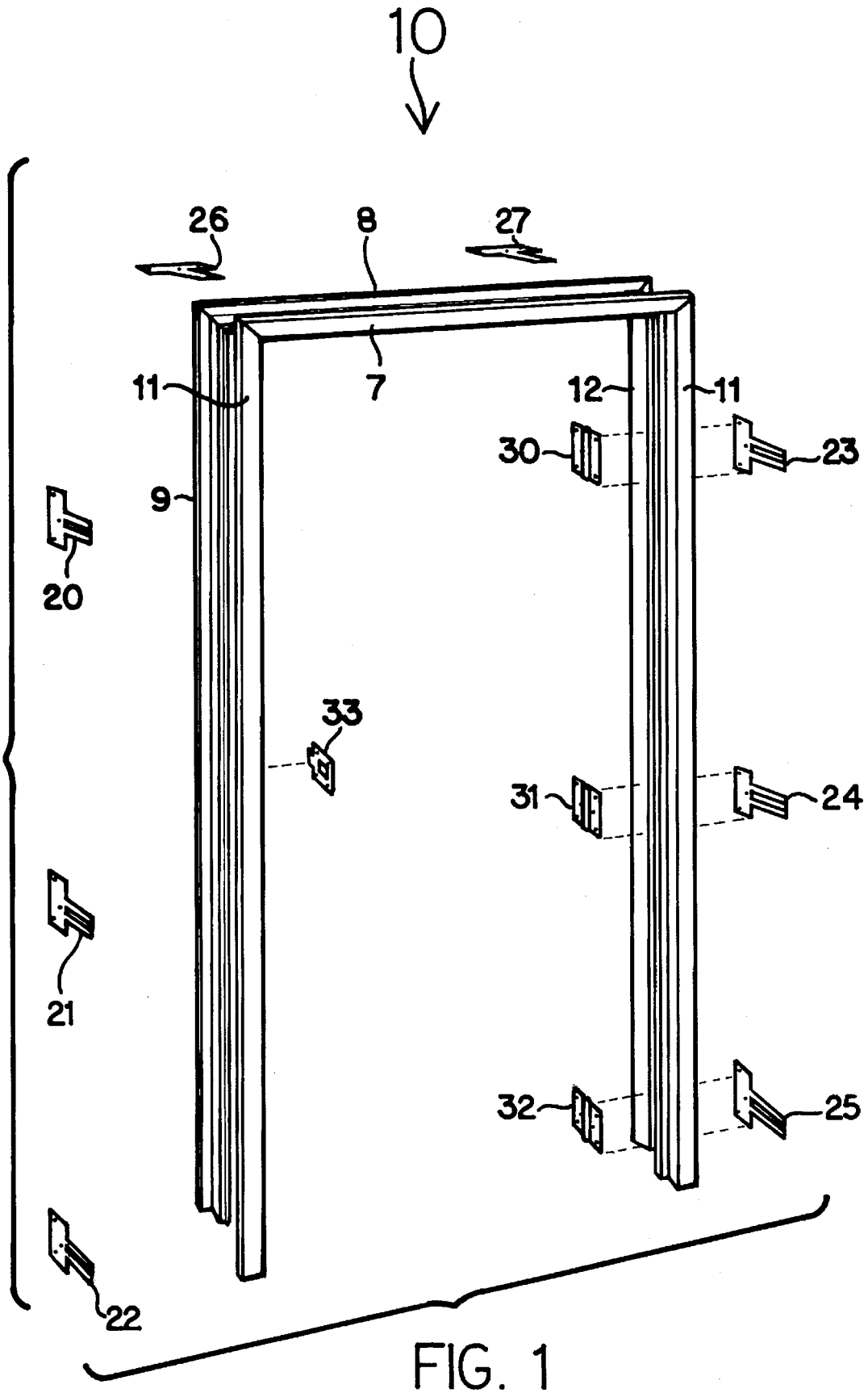
FIG. 1 is an exploded perspective view of the extruded vinyl door jamb assembly.

Referring now to FIGS. 1 through 8, the preferred embodiment of vinyl door jamb assembly 10 is shown to advantage. In FIG. 1, various basic components of extruded vinyl door jamb system 10 are shown. Vinyl jamb member second sections 11, are shown in relationship to its counterparts, vinyl jamb member first section 12 and third section 9. Also shown are vinyl jamb header first and second sections 8 and 7. Additionally, jamb backing members 20 through 27 are shown. Similarly, hinges 30, 31 and 32 are shown, as well as strike plate 33.

Figure 2:
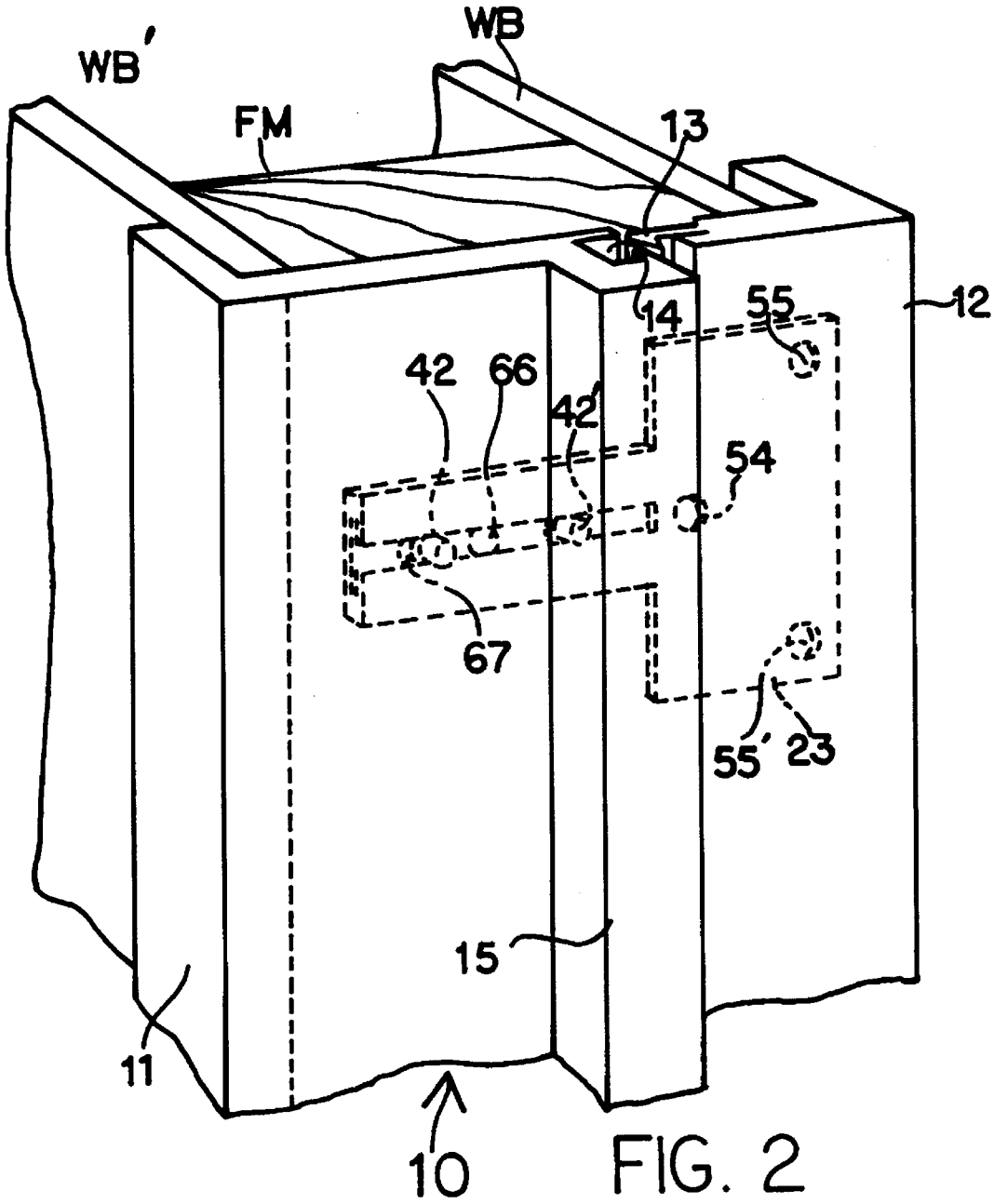
FIG. 2 is a sectional perspective detail of the extruded vinyl door jamb assembly.

FIG. 2 is a front perspective view showing vinyl jamb member second section 11 and vinyl jamb member first section 12. FIG. 2 also shows to advantage snap connector 13 with snap connector receiving means 14. Also shown in FIG. 2 is door stop 15. FIG. 2 additionally shows placement of jamb backing member 23 positioned behind vinyl jamb member second section 11 and vinyl jamb member first section 12.

Figure 3:
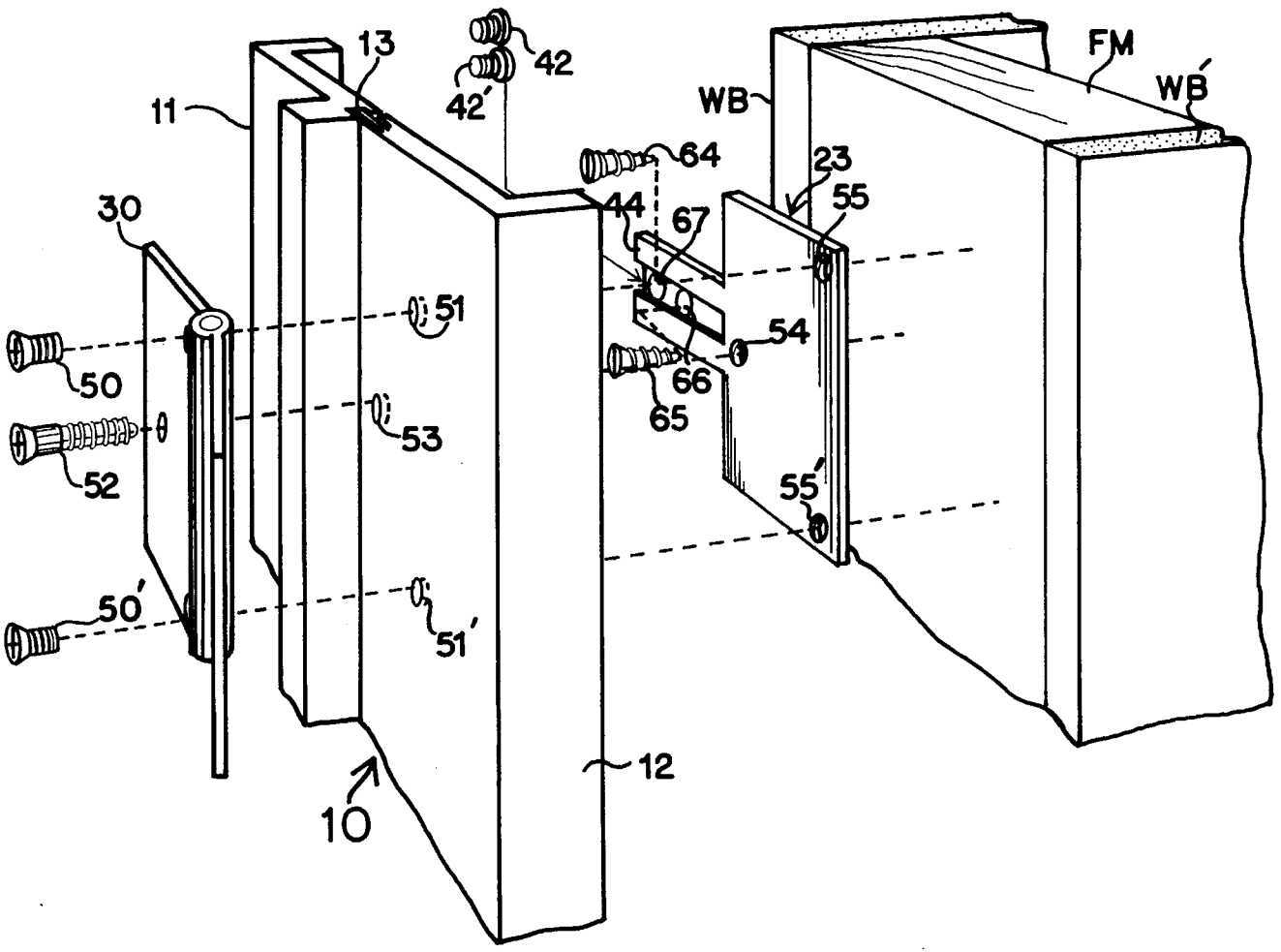
FIG. 3 is an exploded perspective detail of the extruded vinyl door jamb assembly showing placement of the jamb backing member and a hinge.
Figure 6:
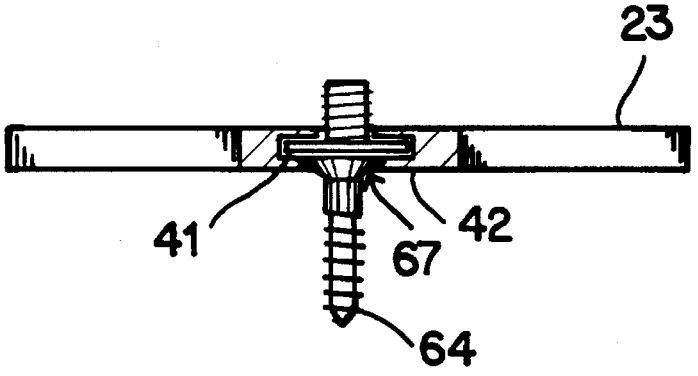
FIG. 6 is a cross-sectional detail of the jamb backing member.

At the heart of vinyl door jamb assembly 10 are the jamb backing members 20 through 27. Jamb backing member 23 is shown with particular detail in FIGS. 2, 3, 5 and 6. It is formed of hinge backing plate section 45, and leg segment 44. Leg segment 44 includes screw head receiving slot 41, which is adapted, as is shown in FIGS. 2, 3 and 6, to receive and hold flat head screws 42 and 42$^1$. Also formed integral with receiving slot 41 and leg segment 44 are mounting screw holes 66 and 67. Jamb backing members 20 through 27 are designed to be positioned against the frame members FM of the structure in which the door jamb assembly is being installed, and held in place by means of wood or metal screws 64 and 65 passing respectively through holes 66 and 67 in leg segments 44.

Figure 4:
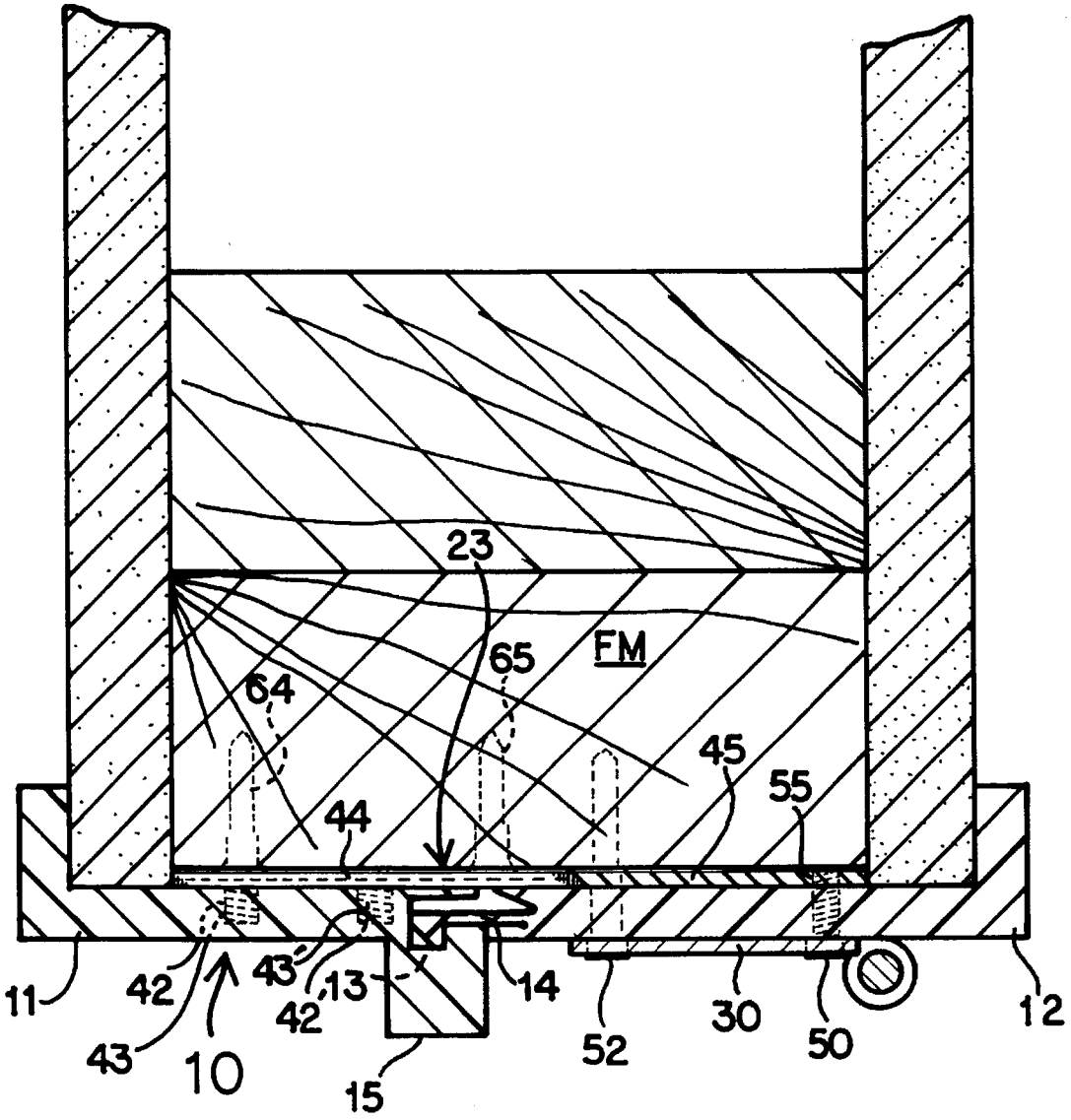
FIG. 4 is a cross-sectional detail of the extruded vinyl door jamb assembly showing placement of the jamb backing member and a hinge.
Figure 5:
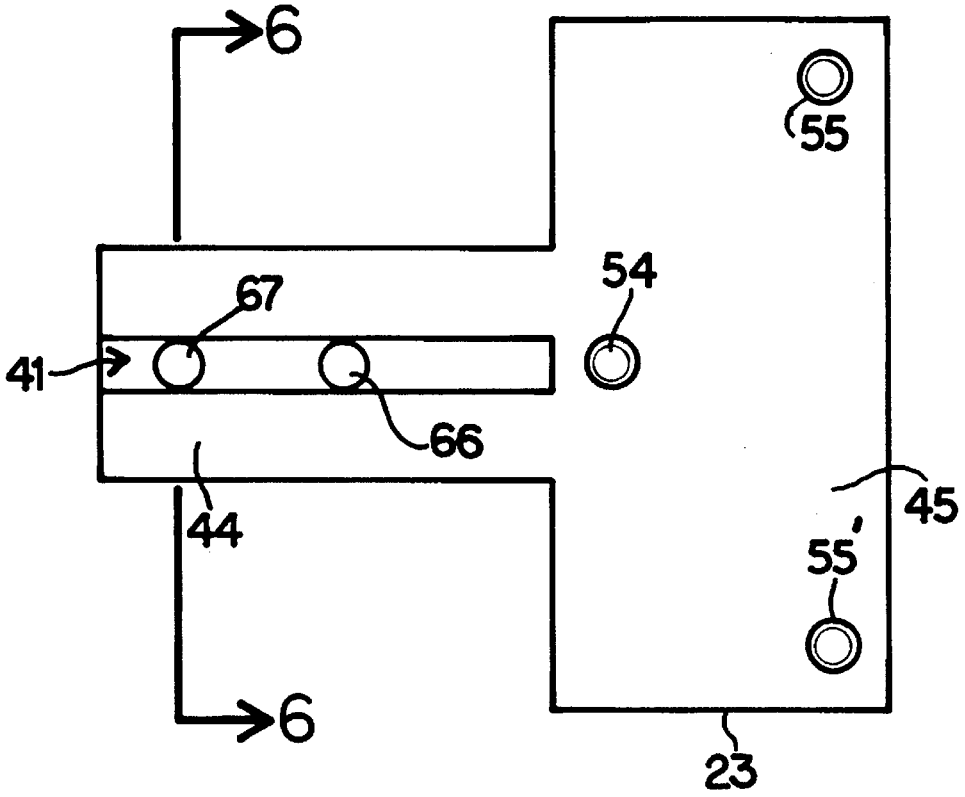
FIG. 5 is a front view of the jamb backing member.

For the hinge side of door jamb assembly 10, jamb backing members 23 through 25 are installed against the frame members FM of the structure, vinyl jamb member first section 12, together with associated hinge 30, are attached to the jamb backing members, as is shown in FIGS. 2, 3 and 4. This is accomplished by means of two machine screws 50 and 50$^1$ passing through holes 51 and 51$^1$and vinyl jamb member first section 12, and threadedly engaging into threaded holes 55 and 55$^1$ in the hinge backing plate 45 section of jamb backing number 23. Metal screw 52 is then used to pass through hinge 30, hole 53 and vinyl jamb first section 12, and hole 54 in hinge backing plate 45 into engagement with wooden or metal frame member FM to securely anchor hinge 30 to the frame member FM. It is this screw 52 which supports the weight of the hinge against frame member FM.

Flathead screws 42 and 42$^1$ are then screwed into threaded screw holes 43 and 43$^1$ formed integral with the back of vinyl jambs member second section 11 with the flat heads extending out just enough so that the flat heads of screws 42 and 42$^1$ will interfit within slot 41 found in leg segment 44. Vinyl jamb member second section 11 is then slid into place with flat head screws 42 and 42$^1$ interfitting within slots 41 of the corresponding jamb backing members 20 through 27 until snap connectors 13 of vinyl jamb member first section 12 engages into snap connector receiving means 14 of vinyl jamb member second section 11 to complete the assembly.

Figure 8:
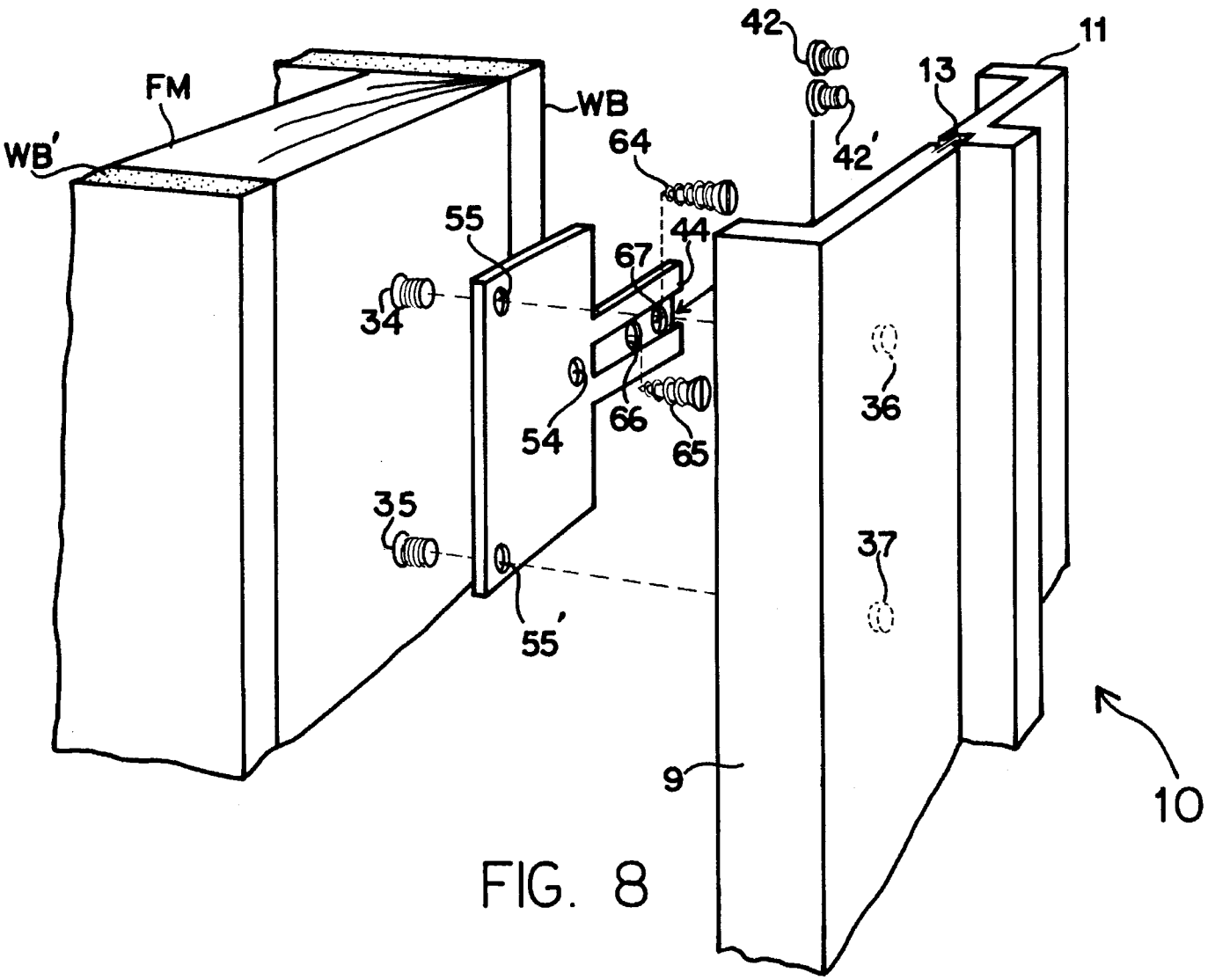
FIG. 8 is an exploded perspective detail of the third vinyl door jamb member showing placement of the metal jamb backing member in a concealed position.

On the opposite side of the door frame, there will be no need for hinges 30. As a result, a vinyl jamb member third section 9 is provided which, as shown in FIG. 8, is provided with two concealed threaded holes 36 and 37 adapted to receive threaded screws 34 and 35 respectively through holes 55 and 55$^1$ to first attach the jamb backing plate 21 to the third section of jamb member 9. Once this is done, leg segment 44 of jamb backing member 21 still extends out and is easily attachable to frame member FM. Once leg segment 44 is attached by means of wood or metal screws 64 and 65 passing through holes 67 and 66, another second section jamb member 11$^1$ can be installed in the same manner to vinyl jamb member third section as it was interconnected with vinyl jamb member first section 12.

The door header is formed in a similar manner, using what are essentially shorter versions of vinyl jamb member second and third sections 9 and 11, now identified as vinyl jamb header second section 7 in FIG. 1, and vinyl jamb header first section 8 in FIG. 1.

Figure 7:
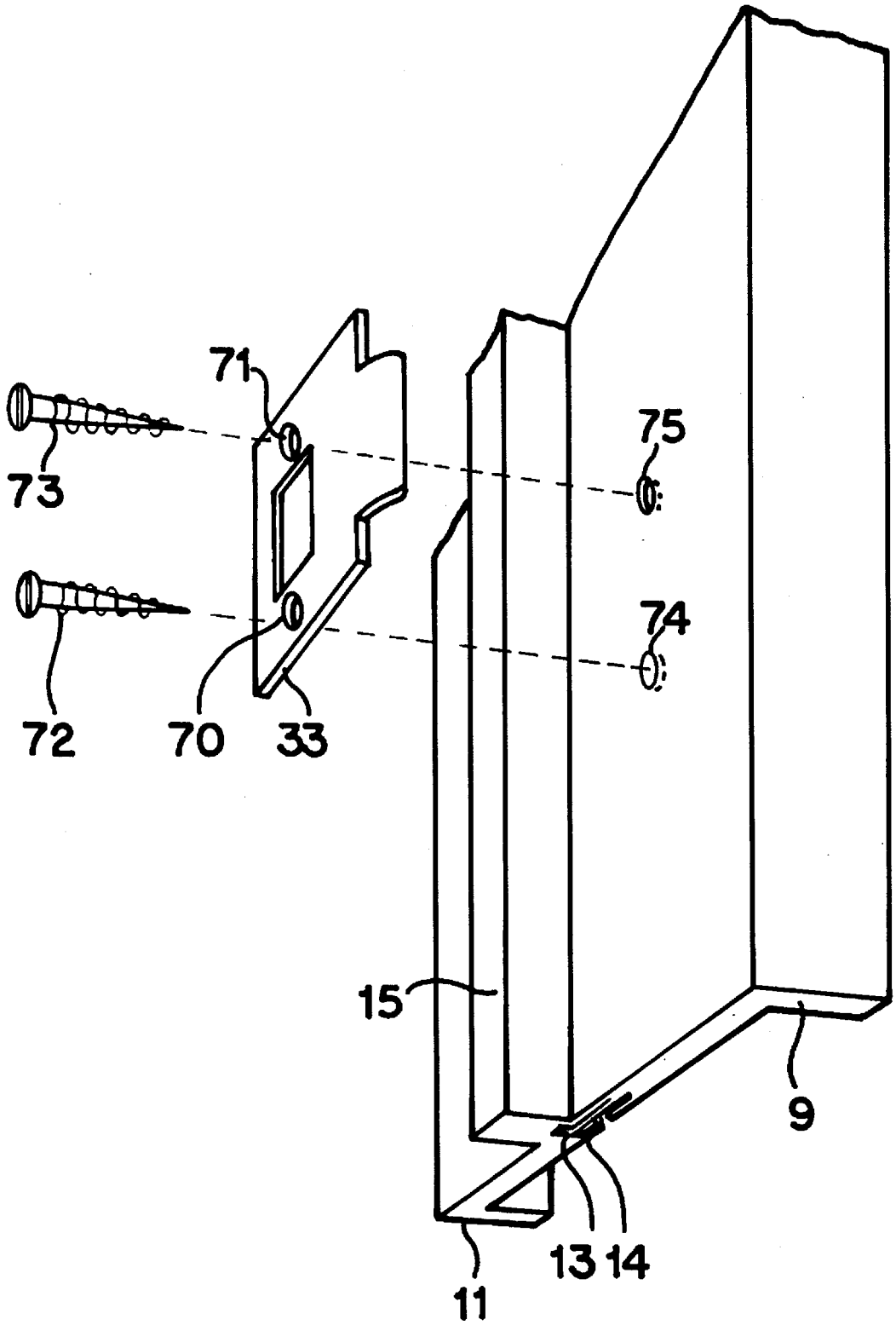
FIG. 7 is an exploded perspective detail of the extruded vinyl door jamb assembly showing placement of the strike plate.

FIG. 7 shows the attachment of strike plate 33 to vinyl jamb member third section 9 by placement of screws 72 and 73 through holes 70 and 71 located in strike plate 33, and holes 74 and 75 located in vinyl jamb member third section 9. Now referring to FIGS. 1 through 8, the installation of the extruded door jamb assembly 10 is described. Jamb backing members 23, 24 and 25 are each first attached to frame members FM in the general locations as shown in FIG. 1. Each is attached by means of wood or metal screws 64 and 65 to frame members FM. Next, vinyl jamb member first section 12 is placed within the framed door opening and attached to the corresponding jamb backing members by means of machine screws 50 and 50$^1$ passing through holes 51 and 51$^1$ in vinyl jamb member first section 12 and threadedly engaged in threaded holes 55 and 55$^1$ of the hinge backing plate section 45 of the corresponding jamb backing members. The hinge plate assembly is completed by use of wood or metal screws 52 passing through hole 53 in vinyl jamb member first section 12 and 54 and hinge backing plate section 45 and into the frame member FM.

Flat head screws 42 and 42$^1$ are then threadedly engaged into the back side of vinyl jamb member second section 11, and the flat head screw portions of screws 42 and 42$^1$ are slid into slots 41 in the leg segments 44 of the corresponding metal jamb backing members, with vinyl jamb member second section 11 being pushed into snap fit engagement with first vinyl jamb member first section 12.

Next, backing members 20, 21 and 22 are attached to the backsides of vinyl jamb members third section 9 by means of threaded screws 34 and 35 passing through hinge backing plate section threaded holes 55 and 55$^1$ and into concealed holes 36 and 37 in vinyl jamb member third section 9. In this manner, the jamb backing plate is attached to the vinyl jamb member third section 9 before it itself is attached to frame member FM. In this configuration, the leg segments 44 of frame backing members 20, 21 and 22 extend out exposing screw holes 66 and 67. The jamb backing members are then screwed, using wood or metal screws 64 and 65, into the frame member, thus attaching vinyl jamb member third section 9 to the door frame. Next, vinyl jamb member second sections 11 are installed in the same manner as they are installed against and snap fitted into engagement with vinyl jamb member first sections 12.

In a like manner, jamb backing members 26 and 27 are first installed to the back sides of vinyl jamb header first section 8 prior to their being screwed or attached to the header section of the door frame. Following this, vinyl jamb header second section 7 is installed in the same manner as the vinyl jamb members second section 11 are installed.

Finally, strike plate 33 is installed by placement of screws 72 and 73 through holes 70 and 71 located in strike plate 33 and holes 74 and 75 located in vinyl jamb member third section 9, passing through vinyl jamb member third section 9 and engaging frame member FM.

While there is shown and described the present preferred embodiment of the invention, it is to be distinctly understood that this invention is not limited thereto but may be variously embodied to practice within the scope of the following claims.

I claim:

1. A vinyl door frame assembly, for a framed door opening having a hinge side frame, striker side frame and a header frame, which comprises:

a plurality of jamb backing members for attachment to the frame members of the framed door opening, said jamb backing members having a hinge backing segment and a leg segment having a generally horizontally oriented axis, said jamb backing members having a plurality of threaded holes and at least one additional hole formed therethrough within the hinge backing segment, the leg segment of each said jamb backing member being further configured to provide a slot along its generally horizontally oriented axis, said slot, in its cross section having a T-shaped configuration;

a vinyl jamb member first section, having a generally L-shaped configuration, said vinyl jamb member first section having a leg segment and a body segment, the body segment having a front side and a back side, the body segment further having a plurality of holes formed therethrough along the length of the body segment for corresponding alignment with the holes in the hinge backing sections of the jamb backing members;

a vinyl jamb member third section having a generally L-shaped configuration, said vinyl jamb member third section having a leg segment, and a body segment, the body segment having a front side and a back side, the body segment further having a plurality of threaded holes formed therein along the length of the body segment for corresponding alignment with the holes in the hinge backing sections of the corresponding jam backing members, said holes being formed from the back side without penetrating through the front side;

a vinyl jamb member second section, having a generally L-shaped configuration, said vinyl jamb member second section having a leg segment, and a body segment, the body segment having a front side and a back side, the body segment further having a plurality of threaded holes formed therein along the length of the body segment for corresponding alignment, said holes being formed from the back side without penetrating through the front side;

a vinyl jamb header first section having a generally L-shaped configuration, said vinyl jamb header first section having a leg segment and a body segment, the body segment having a front side and a back side, the body side further having a plurality of holes formed therein along the length of the body segment for corresponding alignment with the holes in the hinge backing sections of the jamb backing members, said holes being formed from the back side without penetrating through the front side;

a vinyl jamb header second section having a generally L-shaped configuration, said vinyl jamb header second section having a leg segment, and a body segment, the body segment having a front side and a back side, the body segment further having a plurality of threaded holes formed therein along the length of the body segment for corresponding alignment and interfitting engagement within the generally horizontally aligned slot in the leg segment of the corresponding jam backing members, said holes being formed from the back side without penetrating through the front side;

a plurality of hinge means for supporting a door, said hinge means having a plurality of holes therethrough for corresponding alignment with the holes in the jamb backing member hinge backing segments and the holes in the vinyl jam member first sections;

attachment means for engagement in at least one of the plurality of threaded holes formed in the hinge backing sections of the jamb backing members for attaching a hinge means and the vinyl jamb member first section to the hinge backing section of the jamb backing members;

attachment means for engagement in at least one of the plurality of threaded holes in the back side of the vinyl jamb member third section body segment for attaching the hinge backing section of the jamb backing members to the vinyl jamb member third section;

means for attaching the plurality of jam backing members to the hinge side frame door opening with the axis of the leg segments generally horizontally oriented;

attachment means for threaded engagement in at least one of the plurality of threaded holes in the back side of the vinyl jamb member second section body segments, said attachment means configured to slidingly engage within the T-shaped slot of the jamb backing member; and attachment means for threaded engagement in at least one of the plurality of threaded holes in the back side of the vinyl jamb header second section body segment, said attachment means configured to slidably engage within the T-shaped slot of the jamb backing members when attached to the header frame of the framed door opening.

2. The vinyl door frame assembly for a framed door opening of claim 1 wherein each vinyl jamb member second section further comprises a door stop.

3. The vinyl door frame assembly for a framed door opening of claim 1 which further comprises a pair of cooperating snap connector means for interconnecting the first and second vinyl jam member sections.

* * * * *